US010363647B2

(12) United States Patent
Murofushi et al.

(10) Patent No.: US 10,363,647 B2
(45) Date of Patent: Jul. 30, 2019

(54) GRINDING TOOL

(71) Applicant: TOSHIBA KIKAI KABUSHIKI KAISHA, Tokyo-To (JP)

(72) Inventors: Yu Murofushi, Shizuoka-ken (JP); Hiroaki Omagari, Shizuoka-ken (JP); Masateru Tomiyasu, Shizuoka-ken (JP)

(73) Assignee: TOSHIBA KIKAI KABUSHIKI KAISHA, Chiyoda-Ku, Tokyo-To (JP)

( * ) Notice: Subject to any disclaimer, the term of this patent is extended or adjusted under 35 U.S.C. 154(b) by 0 days.

(21) Appl. No.: 15/422,646

(22) Filed: Feb. 2, 2017

(65) Prior Publication Data

US 2017/0225287 A1 Aug. 10, 2017

(30) Foreign Application Priority Data

Feb. 5, 2016 (JP) ..... 2016-021312
Dec. 27, 2016 (JP) ..... 2016-254114

(51) Int. Cl.
*B24B 37/005* (2012.01)
*B24B 37/30* (2012.01)
*B24B 37/20* (2012.01)

(52) U.S. Cl.
CPC ..... *B24B 37/005* (2013.01); *B24B 37/20* (2013.01); *B24B 37/30* (2013.01)

(58) Field of Classification Search
CPC ..... B24B 37/005; B24B 37/20; B24B 37/30
See application file for complete search history.

(56) References Cited

U.S. PATENT DOCUMENTS 5,908,530 A * 6/1999 Hoshizaki ..... B24B 7/241 156/345.14
8,250,720 B2 * 8/2012 Tomioka ..... B24B 39/04 29/90.01
2016/0256976 A1 * 9/2016 Shinozaki ..... B24B 37/005
2016/0368115 A1 * 12/2016 Yasuda ..... B24B 37/32
2017/0047237 A1 * 2/2017 Kobata ..... H01L 22/26
(Continued)

FOREIGN PATENT DOCUMENTS

JP S59-219152 12/1984
JP 05-057606 3/1993
JP H05-57606 A * 3/1993
(Continued)

OTHER PUBLICATIONS

JP 2013-233651 A—Nov. 2013—English Machine Translation.*
(Continued)

*Primary Examiner* — Marc Carlson
(74) *Attorney, Agent, or Firm* — DLA Piper LLP US

(57) ABSTRACT

The polishing apparatus includes: a holding section that holds a material to be polished; the polishing body that polishes the material to be polished held by the holding section; the head that supports the polishing body via the elastic mechanism; a driving mechanism that causes the head to be moved in a Z coordinate direction; and a control unit that is connected to the driving mechanism and controls the driving mechanism. A load measurement device to measure a load applied to the polishing body is attached to the head, and the load measurement device is connected to the polishing body via the elastic mechanism.

4 Claims, 7 Drawing Sheets

(56) References Cited

U.S. PATENT DOCUMENTS

2017/0225288 A1* 8/2017 Omagari ..... B24B 37/005

FOREIGN PATENT DOCUMENTS

| | | |
|---|---|---|
| JP | 2003-094328 | 4/2003 |
| JP | 2003-326456 | 11/2003 |
| JP | 2005-514780 | 5/2005 |
| JP | 2007-181895 | 7/2007 |
| JP | 2008-290173 | 12/2008 |
| JP | 2013-233651 | 11/2013 |
| JP | 2013233651 A * | 11/2013 |
| JP | 2015-036165 | 2/2015 |
| KR | 1999-0014896 | 2/1999 |
| KR | 2001-0054603 | 7/2001 |
| WO | WO 2013/038573 | 3/2013 |

OTHER PUBLICATIONS

JP H05-57606 A—Mar. 1993—English Machine Translation.*
Taiwanese Office Action issued in Taiwanese Application No. 106103734 dated Oct. 17, 2017, with English language translation.
Taiwanese Office Action issued in Taiwanese Application No. 106103725 dated Oct. 17, 2017, with English language translation.
English Language Abstract and Translation of JP S59-219152 published Dec. 10, 1984.
English Language Abstract of JP 2003-094328 published Apr. 3, 2003.
English Language Abstract and Translation of JP 2003-326456 published Nov. 18, 2003.
English Language Abstract and Translation of JP 2005-514780 published May 19, 2005.
English Language Abstract and Translation of JP 2007-181895 published Jul. 19, 2007.
English Language Abstract and Translation of JP 2015-036165 published Feb. 23, 2015.
Korean Office Action issued in KR 10-2017-0015604 dated Feb. 26, 2018.
Korean Office Action issued in KR 10-2017-0015607 dated Mar. 21, 2018.
English Language Abstract of KR 2001-0054603 published Jul. 2, 2001.
English Language Abstract of KR 1999-0014896 published Feb. 25, 1999.
English Language Abstract of JP 05-057606 published Nov. 18, 2003.
U.S. Appl. No. 15/422,652.
Partial Image File Wrapped of Related U.S. Appl. No. 15/422,652 electronically captured from PAIR on May 29, 2019.

* cited by examiner

GRINDING TOOL

CROSS-REFERENCE TO RELATED APPLICATIONS

This application is based upon and claims the benefit of priority from Japanese Patent Application No. 2016-021312, filed on Feb. 5, 2016 and Japanese Patent Application No. 2016-254114, filed on Dec. 27, 2016; the entire contents of which are incorporated herein by reference.

BACKGROUND OF THE INVENTION

Field of the Invention

The present invention relates to a polishing apparatus.

Background Art

Conventionally, a polishing apparatus that uses a polishing pad, which is rotationally driven, as disclosed in WO 2013/038573, for example, has been known as a polishing apparatus that polishes a surface of a wafer made of a semiconductor material, and the like. In general, the polishing pad is provided at a distal end of a rotation shaft. The polishing pad including a rotation mechanism and a rotation shaft is supported by a head via an elastic mechanism. The head is supported by an apparatus main body via a driving mechanism.

It is possible to employ a method of combining position control and load control, as disclosed in JP S59-219152 A, for example, as a method of controlling a driving mechanism. This control method is a method in which the driving mechanism is controlled based on a position (coordinate) of a polishing pad (the position control) until achieving a target load when polishing is performed by the polishing pad in contact with a wafer, and the driving mechanism is controlled based on pressure caused on a contact surface between the polishing pad and the wafer (the load control) after achieving the target load. A position (Z coordinate) of a head when achieving the target load at the time of the polishing is determined based on the area of a polishing surface of the polishing pad and a spring constant value of an elastic mechanism.

It is possible to measure a load applied to the polishing pad using a load cell provided above the rotation shaft of the polishing pad, for example. The measurement procedure is as follows. That is, the head is lowered (moved in a direction of approaching the wafer) along a Z coordinate axis (vertical axis), and the polishing surface of the polishing pad is pushed against the wafer. Along with this, the elastic mechanism (coil spring) is deformed, and the polishing pad and the rotation shaft are relatively moved upward with respect to the head. Accordingly, an upper end portion of the rotation shaft is pushed to the load cell. Further, a strain gauge inside the load cell is deformed, and a force of the upper end portion of the rotation shaft pushing the strain gauge is measured. Further, a Z coordinate value of the head is adjusted such that the force to be measured by the load cell becomes the target load.

In the polishing apparatus described above, the polishing pad is rapidly moved upward (pushed up), and a measurement value of the load cell rapidly increases when a polishing body passes through a location where a tiny protrusion and a foreign substance is present at the time of performing the load control. In general, it is difficult to perform the highly accurate load control in accordance with such a rapid change of the load.

Further, there is a case where an overshoot with respect to the target load at the time of polishing is caused due to expansion and contraction of the elastic body when the position control is switched to the load control in such a polishing apparatus. When the overshoot is generated, a deviation occurs in a cut amount (polishing depth) of the wafer, and as a result, the accuracy in polishing of the wafer deteriorates. Examples of a technique of reducing the overshoot with respect to the target load in the polishing apparatus that performs the load control are disclosed in JP 2003-94328 A, JP 2003-326456 A, JP 2005-514780 A, JP 2007-181895 A, and JP 2015-35165 A. However, none of the documents has conducted studies on a method of reducing the overshoot caused by expansion and contraction of the elastic mechanism.

SUMMARY OF THE INVENTION

The inventors of the present application have found out that it is effective to provide an elastic mechanism between a rotation shaft of a polishing pad and a load cell, as a result of diligently repeating studies.

In addition, the inventors of the present application have found out that it is possible to resolve the overshoot by switching position control to load control at a position where the overshoot does not occur based on the spring constant value of the elastic mechanism.

The invention has been made based on the above-described findings. That is, an object of the invention is to provide a polishing apparatus capable of measuring only a load that is stabilized when a load cell is practically stationary.

Further, another object of the invention is to provide a polishing apparatus capable of avoiding an overshoot with respect to a target load at the time of polishing caused when position control is switched to load control.

An embodiment of the invention is a polishing apparatus including: a holding section that holds a material to be polished; a polishing body that polishes the material to be polished held by the holding section; a head that supports the polishing body via an elastic mechanism; a driving mechanism that causes the head to be moved in a Z coordinate direction; and a control unit that is connected to the driving mechanism and controls the driving mechanism, wherein a load measurement device to measure a load applied to the polishing body is attached to the head, and the load measurement device is connected to the polishing body via the elastic mechanism.

According to the invention, it is possible to provide the polishing apparatus capable of measuring only a stable load when the load measurement device (load cell) is practically stationary due to the presence of the elastic mechanism even when the polishing pad passes through a location where a tiny protrusion or a foreign substance is present on a surface of a wafer.

In the above-described polishing apparatus, it preferable that the control unit initially performs position control of the driving mechanism when lowering the head using the driving mechanism and switches to load control of the driving mechanism ahead of a position which is a Z coordinate when a target load is achieved.

In this case, it is possible to provide the polishing apparatus capable of avoiding the overshoot of the load with respect to the target load at the time of polishing caused when the position control is switched to the load control.

Preferably, the elastic mechanism includes a coil spring. In this case, it is possible to implement the elastic mechanism at low cost.

Alternatively, another embodiment of the invention is a polishing apparatus including: a holding section that holds a material to be polished; a polishing body that polishes the material to be polished held by the holding section; a head that supports the polishing body via an elastic mechanism; a driving mechanism that causes the head to be moved in a Z coordinate direction; and a control unit that is connected to the driving mechanism and controls the driving mechanism, wherein the control unit initially performs position control of the driving mechanism when lowering the head using the driving mechanism, and switches to load control of the driving mechanism ahead of a position which is a Z coordinate when a target load is achieved.

According to the invention, it is possible to provide the polishing apparatus capable of avoiding the overshoot of the load with respect to the target load at the time of polishing caused when the position control is switched to the load control.

According to the invention, it is possible to provide the polishing apparatus capable of measuring only a stable load when the load measurement device (load cell) is practically stationary due to the presence of the elastic mechanism even when the polishing pad passes through a location where a tiny protrusion or a foreign substance is present on a surface of a wafer.

In addition, it is possible to provide the polishing apparatus capable of avoiding the overshoot of the load with respect to the target load at the time of polishing caused when the position control is switched to the load control according to the invention.

DETAILED DESCRIPTION OF THE INVENTION

Hereinafter, an embodiment of the invention will be described in detail with reference to the accompanying drawings.

Figure 1:
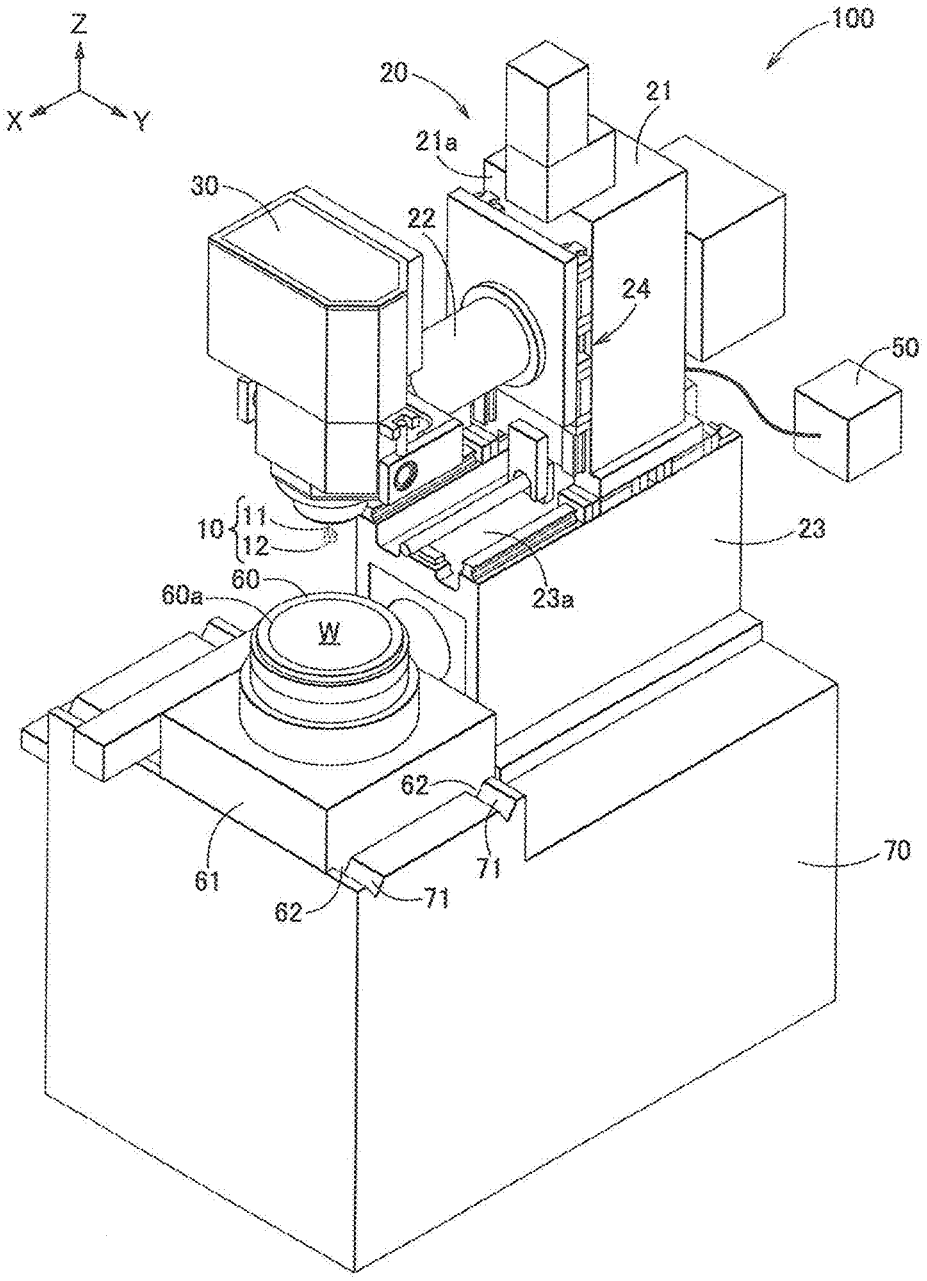
FIG. 1 is a schematic perspective view illustrating a polishing apparatus according to a first embodiment of the invention.

FIG. 1 is a schematic perspective view illustrating a polishing apparatus 100 according to an embodiment of the invention. As illustrated in FIG. 1, the polishing apparatus 100 according to this embodiment includes: a bed 70; a table 60 which is provided on the bed 70 and serves as a holding section that holds a material to be polished (wafer W); a polishing body 10 that polishes the material to be polished held by the table 60; a head 30 that supports the polishing body 10 via an elastic mechanism 32 (see FIG. 2); a driving mechanism 24 that causes the head 30 to be moved in a Z coordinate direction (up-and-down direction in FIG. 1) with respect to apparatus main body 20; and a control unit 50 that is connected to the driving mechanism 24 and controls the driving mechanism 24.

Among them, the table (holding section) 60 is configured to hold the discoid wafer W serving as the material to be polished. The table 60 is supported by a cuboid support block 61 which is arranged on the bed 70.

In addition, the polishing body 10 polishes the wafer W held by the table 60. As illustrated in FIG. 1, the polishing body 10 includes a spindle 11 and a polishing pad 12 attached to one end portion (lower end portion in FIG. 1) of the spindle 11. A discoid shape with a diameter of 10 mm is employed as the polishing pad 12 according to this embodiment.

The apparatus main body 20 according to this embodiment is configured to support the head 30 via the driving mechanism 24 that causes the head 30 to be relatively moved with respect to the wafer W. As illustrated in FIG. 1, the apparatus main body 20 includes a cuboid column 21, a cylindrical arm 22 whose one end is supported on one side surface 21*a* of the column 21 via the driving mechanism 24, and a cuboid base 23 which supports the column 21 at an upper surface 23*a*. The head 30 is attached to the other end of the arm 22. It is configured such that the arm 22 is moved on the one side surface 21*a* of the column 21 in a vertical direction (Z coordinate direction of FIG. 1) by the driving mechanism 24. Accordingly, positioning of the head 30 in the Z coordinate direction is performed.

In addition, it is configured such that the column 21 according to this embodiment is moved on the base 23 in a length direction of the arm 22 (an X coordinate direction of FIG. 1) by the existing driving mechanism. Accordingly, positioning of the head 30 in the X coordinate direction is performed.

In addition, the bed 70 is configured to support the support block 61 of the table 60 and the apparatus main body 20 as illustrated in FIG. 1. To be specific, the table 60 and the support block 61 are arranged on an upper surface of the bed 70 at a position that corresponds to the polishing body 10. In this embodiment, ridges 62 to be engaged with two parallel grooves 71, carved on the bed 70 along a Y coordinate direction of FIG. 1, are provided on a lower surface of the support block 61, and the support block 61 is capable of moving along the two parallel grooves 71. Accordingly, positioning of the table 60 in the Y coordinate direction, that is, positioning of the head 30 in the Y coordinate direction with respect to the table 60 is performed. The table 60 according to this embodiment includes a mounting surface 60*a* whose diameter is, for example, 200 mm.

Figure 2:
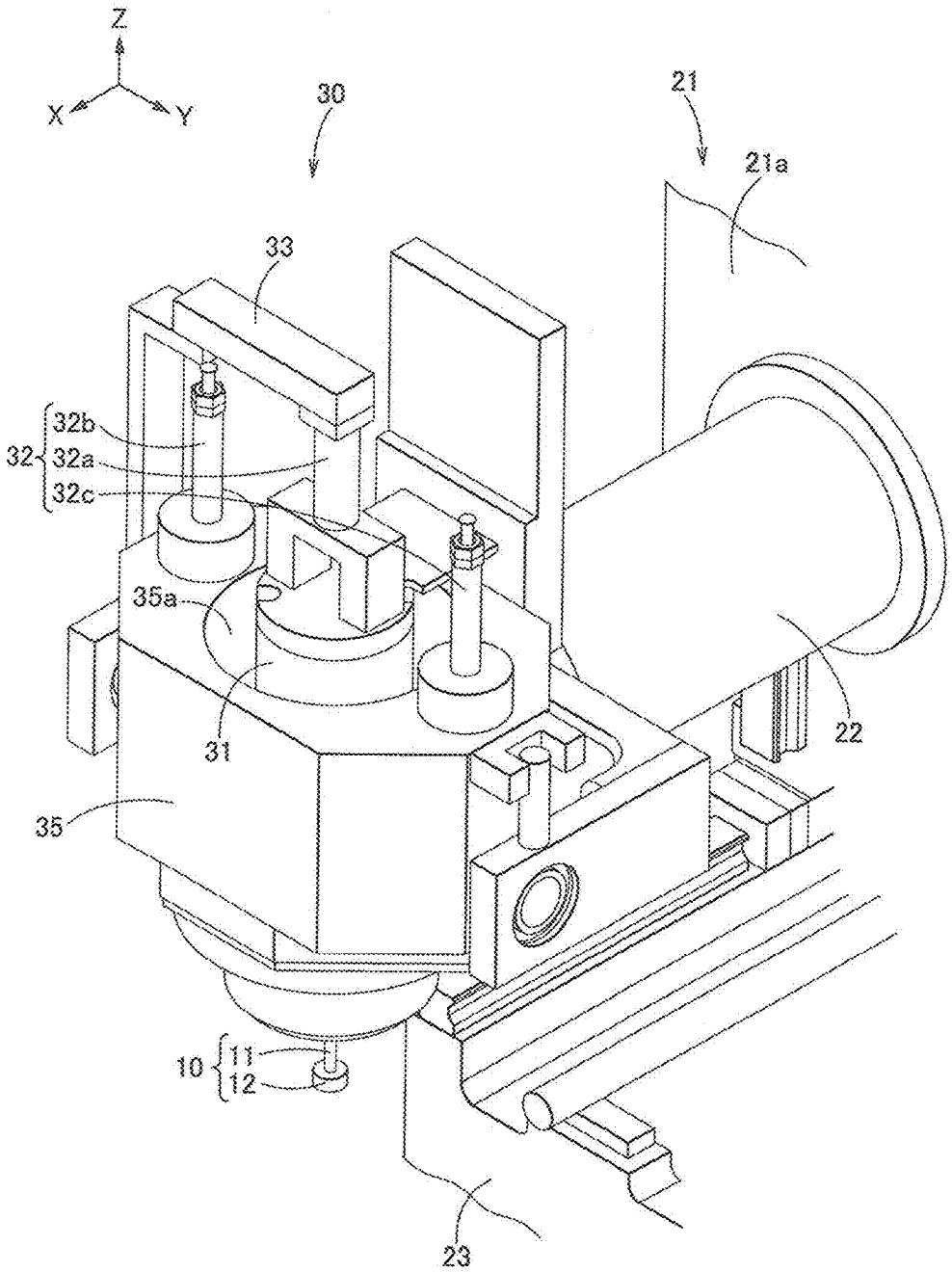
FIG. 2 is a schematic perspective view illustrating an internal structure of a head of the polishing apparatus illustrated in FIG. 1.
Figure 3:
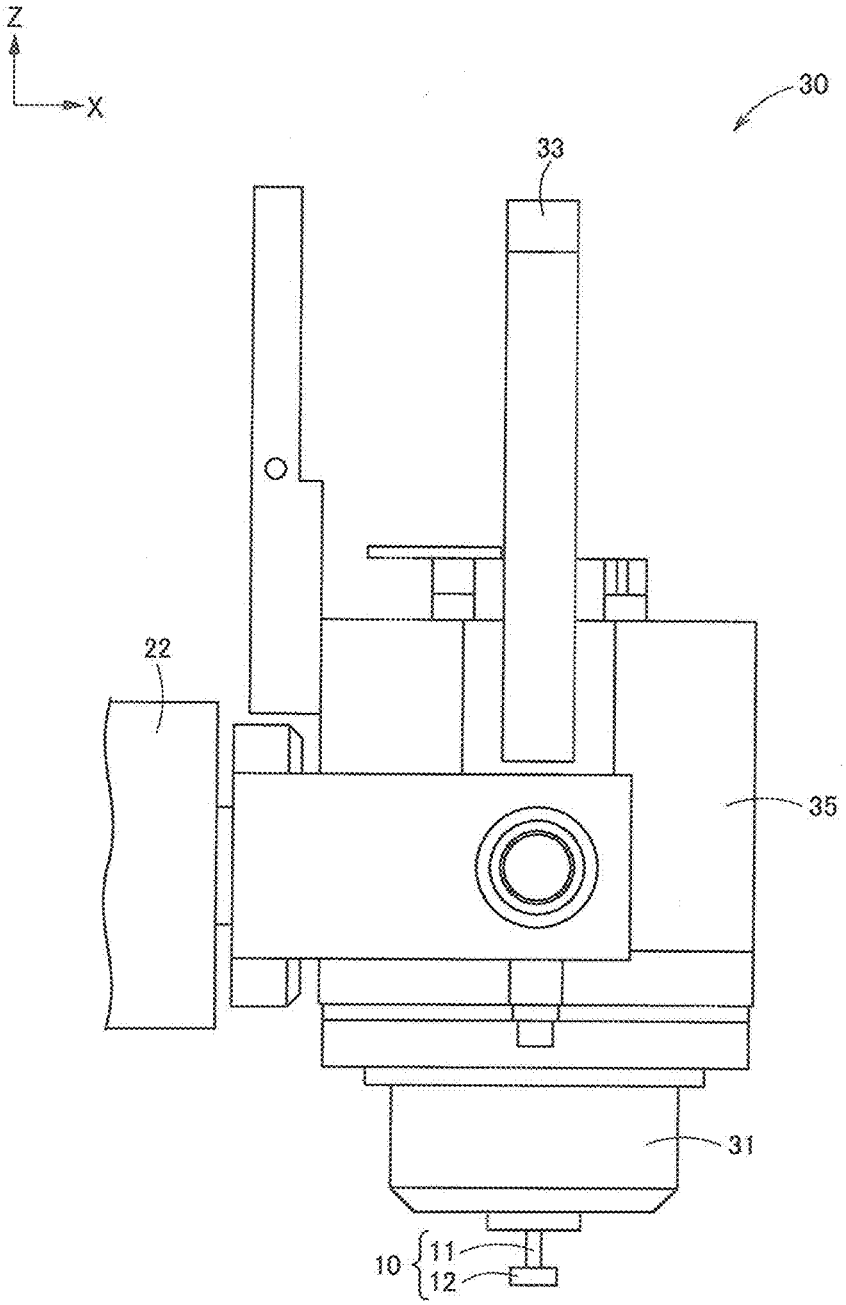
FIG. 3 is a schematic side view in a case where the head of the polishing apparatus illustrate in FIG. 1 is viewed from the upper left of FIG. 2.

Next, a configuration of the head 30 will be further described. FIG. 2 is a schematic perspective view illustrating an internal structure of the head 30 of the polishing apparatus 100 illustrated in FIG. 1; FIG. 3 is a schematic side view in a case where the head 30 of the polishing apparatus 100 illustrated in FIG. 1 is viewed from the upper left of FIG. 2; and FIG. 4 is a schematic cross-sectional view of the head 30 of FIG. 3 in a plane that passes through a shaft center of the spindle 11 in parallel to the paper surface of FIG. 3.

Figure 4:
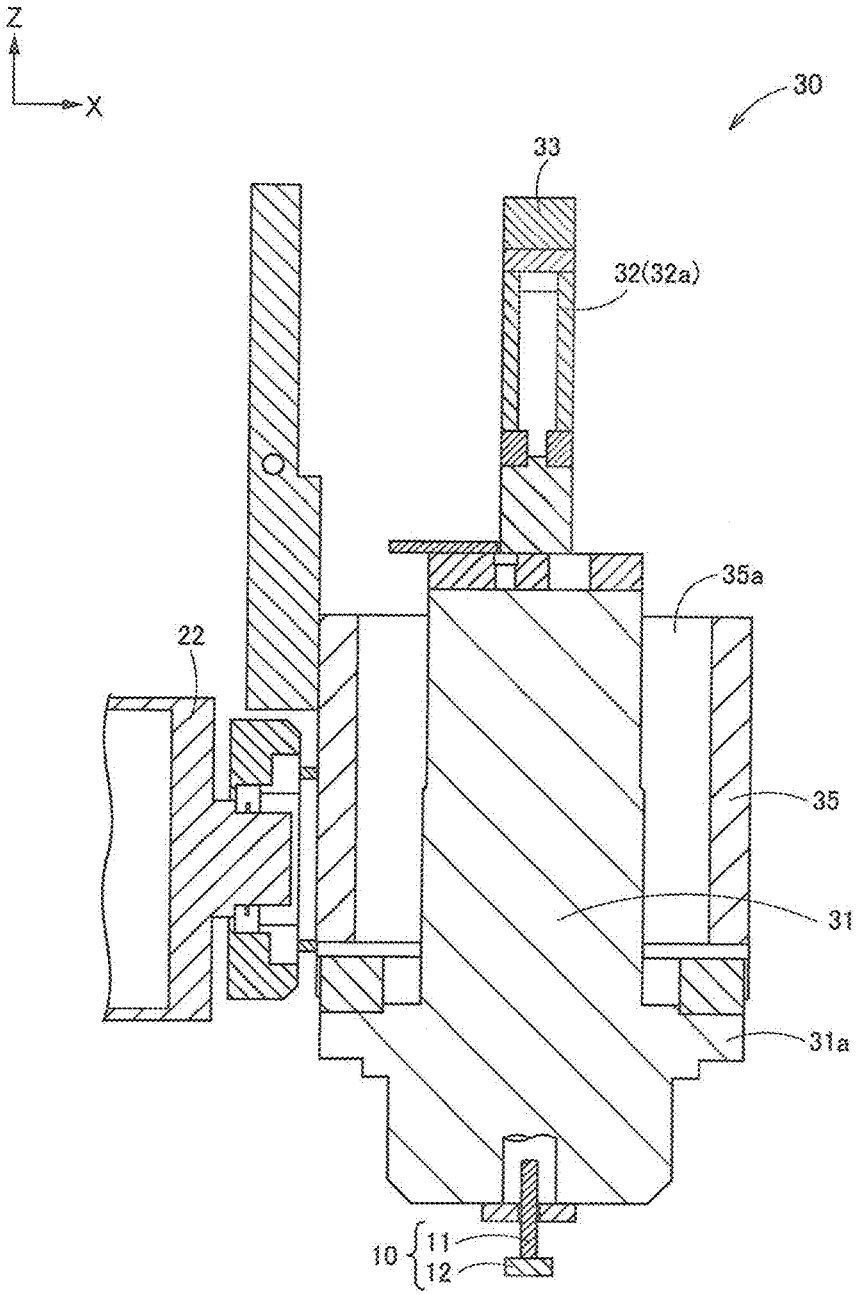
FIG. 4 is a schematic cross-sectional view of the head of FIG. 3 in a plane that passes through a shaft center of a spindle in parallel to the paper surface of FIG. 3.

As illustrated in FIGS. 2 to 4, the head 30 according to this embodiment is configured to support the polishing body 10.

This head 30 includes a polishing body support member 31 that is supported via the elastic mechanism 32 and supports the spindle 11 of the polishing body 10. The existing driving mechanism (not illustrated), which causes the spindle 11 to be rotatably driven, is provided inside the polishing body support member 31 so as to rotate the polishing body 10 at desired rotational speed. As illustrated in FIG. 4, the polishing body support member 31 is formed in a cylindrical shape which has a flange portion 31*a* on a side surface thereof, and a cover 35 that is fixed to the arm 22 and surrounds the polishing body support member 31 is provided above the flange portion 31*a*. An outer shape of the cover 35 is an octagonal prism as illustrated in FIG. 2. A through-hole 35*a* is formed in the cover 35 in the up-and-down direction, and the polishing body support member 31 is capable of moving in the up-and-down direction inside the through-hole 35*a*.

In addition, the elastic mechanism 32 according to this embodiment is configured of one pressing spring 32*a*, which presses the polishing body 10 downward together with the polishing body support member 31, and two balancing springs 32*b* and 32*c* to support the own weight of the polishing body support member 31 as illustrated in FIG. 2. The pressing spring 32*a* is provided at the upper end of the polishing body support member 31, and is configured to generate a resilient force along the shaft center of the spindle 11 of the polishing body 10. In addition, the balancing springs 32*b* and 32*c* are provided on an upper surface of the cover 35 at both sides of the pressing spring 32*a* in the Y-axis direction to be parallel with the pressing spring 32*a*. In this embodiment, the upper end of the pressing spring 32*a* is connected to a load cell (load measurement device) 33 such that a load applied to the polishing body 10 is measured via the pressing spring 32*a*.

Figure 5:
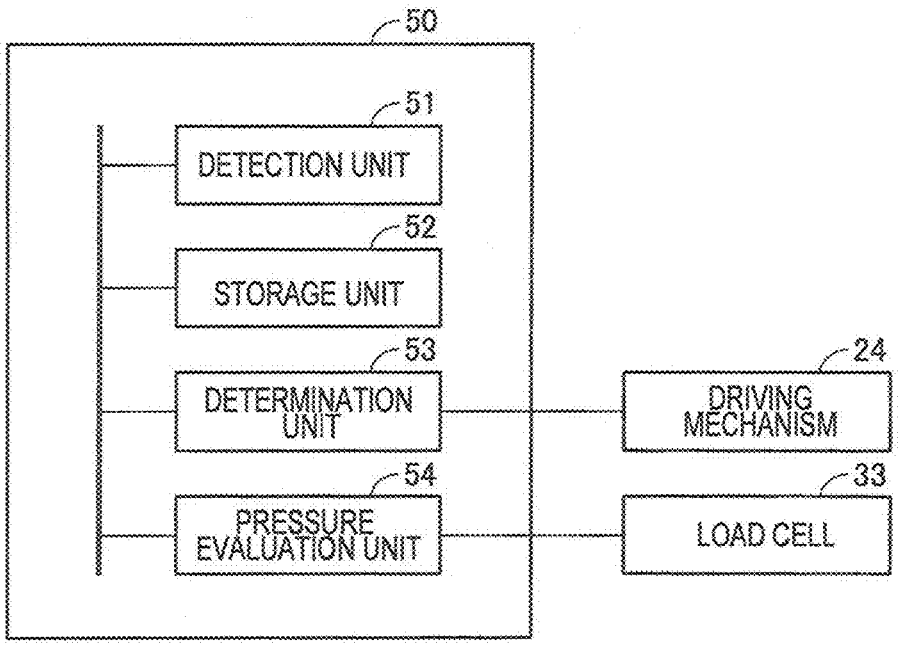
FIG. 5 is a block diagram schematically illustrating a control device of the polishing apparatus illustrated in FIG. 1.

FIG. 5 is a schematic block diagram of a control device 50 that is connected to the polishing apparatus 100 illustrated in FIG. 1. As illustrated in FIG. 5, the control device 50 according to this embodiment includes: a detection unit 51 that detects a relative position relationship between the shaft center of the spindle 11 of the polishing body 10 and a rotation center of the table 60; a storage unit 52 that stores a Z coordinate of the polishing body support member 31 when position control is switched to load control; a determination unit 53 that determines whether the polishing body support member 31 reaches the Z coordinate; and a pressure evaluation unit 54 that evaluates a contact area between the polishing pad 12 and the wafer W based on the relative position relationship detected by the detection unit 51 and evaluates whether pressure applied to the wafer W is suitable based on the contact area and a measurement value of the load cell 33.

Incidentally, the head 30 according to this embodiment supports the polishing body support member 31 via the elastic mechanism 32 as described above. When the polishing body support member 31 is moved to a position where a target load set in advance is applied to the wafer W due to a repulsive force by the elastic mechanism 32, an overshoot (excessive movement or excessive entrance) with respect to the target load occurs as described above. This behavior of the overshoot can be read from a graph in FIG. 6 that illustrates a load applied to the polishing body 10 in a polishing apparatus of the related art. This graph shows the load applied to the polishing body 10, in a time-series manner, in a case where a process of performing polishing by linearly moving the polishing body 10 along the X coordinate direction from an edge portion of the wafer W to the other edge portion is repeated three times. In this embodiment, a degree of the overshoot, which is generated when the polishing body support member 31 is moved up to the position where the target load set in advance is applied to the wafer W, is measured by an experiment in advance, and stored in the storage unit 52.

Figure 6:
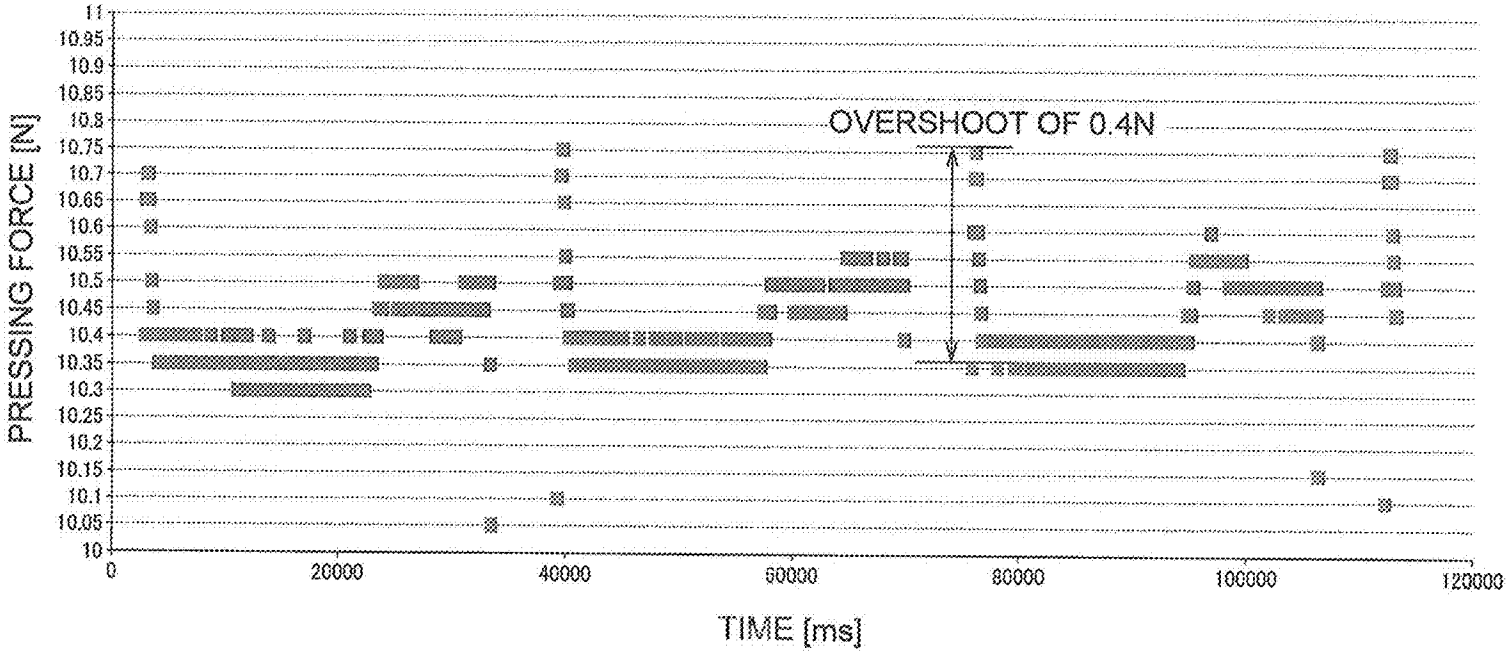
FIG. 6 is a graph illustrating a load which is applied to a polishing body in a polishing apparatus of the related art.

To be specific, a case where the position control is performed until the target load at the time of polishing is achieved is assumed in the polishing apparatus 100 illustrated in FIG. 1. In this case, an overshoot of about 0.4 N is generated with respect to the target load as illustrated in FIG. 6. In order to suppress this overshoot, the polishing apparatus 100 is configured such that the driving mechanism 24 is controlled by performing switching to the load control at a position ahead of the position (Z coordinate) when the target load is achieved. This front position is calculated by, for example, dividing (an overshoot amount (N) when the position control is performed until achieving the target load) by (total spring constant value (N/mm) of the elastic mechanism 32). The total spring constant value of the elastic mechanism 32 employed in the head 30 according to this embodiment is 20 N/mm. Accordingly, the position control may be switched to the load control at a position ahead of the Z coordinate at the time of achieving the target load by 0.4 (N)/20 (N/mm)=20 (μm). This numeric value of 20 μm is stored in the storage unit 52 in advance.

Next, an effect of the polishing apparatus 100 according to this embodiment will be described.

First, the table 60 is positioned along the two parallel grooves 71 carved on the bed 70 such that the rotation center of the table 60 and the shaft center of the spindle 11 of the polishing body 10 match each other in the Y-axis direction as illustrated in FIG. 1, prior to a polishing process. The wafer W as the material to be polished is mounted to the table 60 such that a surface to be polished faces upward. Further, when a user activates the polishing apparatus 100, the column 21 is moved on the base 23 until the rotation center of the table 60 and the shaft center of the spindle 11 of the polishing body 10 match each other in the X-axis direction of FIG. 1. At this time, the head 30 is retreated to have a sufficient height in an initial state such that the polishing pad 12 of the polishing body 10 does not interfere an edge portion of the table 60.

Further, each of the spindle 11 of the polishing body 10 and the driving mechanism of the table 60 is activated based on a command of the user, and the polishing body 10 and the table 60 are rotated at each desired speed. That is, the polishing, pad 12 and the wafer W are rotated at each desired speed. In this state, the head 30 is moved downward together with the arm 22 by the driving mechanism 24 provided in the column 21, and the polishing pad 12 is pushed against the wafer W. In this embodiment, a polishing liquid is supplied to the surface of the wafer W to be polished before the polishing pad 12 is pushed against the wafer W in order to perform the smooth polishing process.

In the polishing apparatus 100 according to this embodiment, the movement of the head 30 until the polishing pad 12 is pushed against the wafer W is controlled as the position control, that is, based on the position (Z coordinate) of the head 30. Further, the switching to the load control is performed before reaching the target load at the time of polishing after the polishing pad 12 is pushed against the wafer W. To be specific, the position control is switched to the load control by the position control at a position ahead of (above), by a predetermined distance, the position (Z coordinate) of the head 30 when the target load is reached. This predetermined distance is obtained by measurement in advance and stored in the storage unit 52, and is 20 μm in the example illustrated in FIG. 6. In the load control according to this embodiment, the load applied to the polishing body 10, that is, load to be measured by the load cell 33 is controlled by adjusting the position (Z coordinate) of the head 30 such that the pressure (surface pressure), applied to the contract surface between the wafer W and the polishing pad 12, becomes constant.

After switching to the load control, the pressure evaluation unit 54 monitors the pressure (surface pressure), applied to the contract surface between the wafer W and the polishing pad 12 in real time. This pressure is set on the basis of the load to be measured by the load cell 33 via the pressing spring 32*a* and the contact area between the polishing pad 12 and the wafer W evaluated based on the relative position relationship between the shaft center of the spindle 11 of the polishing body 10 and the table 60. In this embodiment, the polishing pad 12 gradually approaches the wafer W from the upper side of the wafer W, and at the same time, is moved from a radially outward side of the wafer W to a radially inward side thereof. Then, a part of the polishing pad 12 is pushed against the wafer W, and the polishing of the wafer W is started. The polishing pad 12 is gradually moved to the radially inward side of the wafer W. Along with this, the contact area between a polishing surface of the polishing pad 12 and the wafer W gradually increases, and the contact area becomes constant eventually as the entire polishing surface is brought into contact with the wafer W. In this embodiment, the load to be measured by the load cell 33 gradually increases, and then, becomes constant since the position (Z coordinate) of the head 30 is controlled such that the pressure (surface pressure) applied to the contact surface between the polishing pad 12 and the wafer W becomes constant.

At the time of polishing the wafer W, the polishing body 10 is linearly moved along the X coordinate direction from one peripheral edge portion to the other peripheral edge portion of the wafer W as the column 21 is moved on the base 23. When the polishing body 10 passes through a location where a tiny protrusion or a foreign substance is present on the surface of the wafer W in the course of polishing, the polishing body 10 is rapidly moved upward (pushed up). At this time, if the elastic mechanism 32 is not present and the polishing body support member 31 is directly connected to the load cell 33, a measurement value of the load cell 33 rapidly increases. In general, it is difficult to perform the highly accurate load control in accordance with such a rapid change of the load.

On the contrary, the pressing spring 32*a* is attached between the polishing body support member 31 and the load cell 33 in the polishing apparatus 100 according to this embodiment, and thus, the pressing spring 32*a* functions as a damper. Therefore, there is no rapid increase of the load that is detected by the load cell 33.

A thickness of the wafer W is decreased along with the process of polishing the wafer W, and the head 30 is moved downward together with the arm 22 by the driving mechanism 24 provided in the column 21 when the load applied to the polishing body 10 decreases. The polishing body 10 is strongly pushed against the wafer W due to such movement, and thus, the load applied to the polishing body 10 increases, and the pressing spring 32*a* is compressed. Further, the movement is stopped when the load cell 33 detects a recovery of an optimal load applied to the polishing body 10 registered, in advance, in the polishing apparatus 100.

Figure 7:
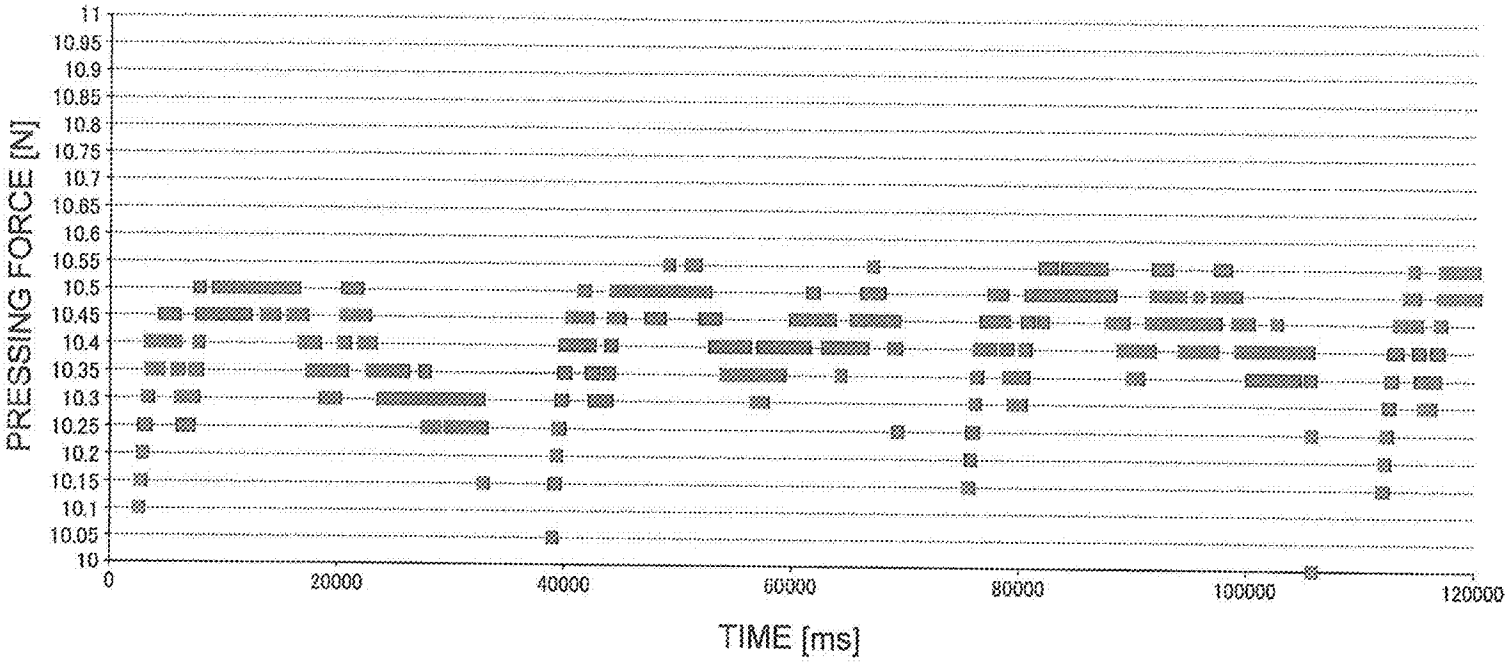
FIG. 7 is a graph illustrating a load which is applied to a polishing body in the polishing apparatus according to this embodiment.

FIG. 7 illustrates a graph illustrating the load applied to the polishing body 10 in the polishing apparatus 100 according to this embodiment. As illustrated in FIG. 7, it is confirmed that there is no point at which the load prominently increases as compared to the case illustrated in FIG. 6, and the overshoot is definitely avoided in the polishing apparatus 100 according to this embodiment.

Further, when desired polishing processing has been achieved, the supply of the polishing liquid is stopped, and the head 30 is moved upward together with the arm 22 by the driving mechanism 24. Further, each rotation of the polishing body 10 and the table 60 is stopped based on the user's command, and the wafer W is removed from the table 60. At this time, the column 21 is moved on the base 23 in the negative direction of the X coordinate of FIG. 1 if necessary, and the head 30 is retreated.

According to the above-described embodiment, it is possible to provide the polishing apparatus 100 capable of measuring only a stable load when the load cell 33 is practically stationary due to the presence of the elastic mechanism 32 even when the polishing pad 12 passes through the location where the tiny protrusion or the foreign substance is present on the surface of the wafer W.

In other words, it is possible to significantly improve a resolution of detection of the load with respect to a resolution of detection of the position of the head 30 according to the driving mechanism 24.

In addition, it is possible to implement the elastic mechanism 32 at low cost since the elastic mechanism 32 includes coil springs (the pressing spring 32*a* and the balancing springs 32*b* and 32*c*).

Further, it is possible to provide the polishing apparatus 100 capable of avoiding the overshoot of the load with respect to the target load at the time of polishing caused when the position control is switched to the load control according to the invention.

Although the polishing body 10 is rotatably supported by the polishing body support member 31 via the spindle 11 in this embodiment, the polishing body 10 is not necessarily configured to be rotatably supported.

The invention claimed is:

1. A polishing apparatus comprising:

a holding section configured to hold a material to be polished;

a polishing body configured to polish the material to be polished held by the holding section;

a head that supports the polishing body via an elastic mechanism;

a driving mechanism configured to cause the head to be moved in a Z coordinate direction; and a control unit that is connected to the driving mechanism and that is configured to:

selectively carry out position control of the polishing body and, separately, load control of the load applied to the polishing body; and control the driving mechanism by initially performing the position control of the driving mechanism when lowering the head using the driving mechanism and switching to the load control of the driving mechanism ahead of a position which is a Z coordinate when a target load is achieved, wherein a load measurement device to measure a load applied to the polishing body is attached to the head, and the load measurement device is connected to the polishing body via the elastic mechanism.

2. The polishing apparatus according to claim 1, wherein the elastic mechanism includes a coil spring.

3. The polishing apparatus according to claim 1, wherein the Z coordinate is calculated based on an overshoot amount that occurs in response to the position control being continued until the target load is achieved.

4. A polishing apparatus comprising:

a holding section configured to hold a material to be polished;

a polishing body configured to polish the material to be polished held by the holding section;

a head that supports the polishing body via an elastic mechanism;

a driving mechanism configured to cause the head to be moved in a Z coordinate direction; and a control unit that is connected to the driving mechanism and that is configured to:

selectively carry out position control of the polishing body and, separately, load control of the load applied to the polishing body; and control the driving mechanism by initially performing the position control of the driving mechanism when lowering the head using the driving mechanism and switching to the load control of the driving mechanism ahead of a position which is a Z coordinate when a target load is achieved.

* * * * *